United States Patent [19]

Budde

[11] 4,406,596

[45] Sep. 27, 1983

[54] COMPRESSED AIR DRIVEN DOUBLE DIAPHRAGM PUMP

[76] Inventor: Dirk Budde, Donatusstrasse 37, 4052 Korschenbroich 1, Fed. Rep. of Germany

[21] Appl. No.: 287,324

[22] Filed: Jul. 27, 1981

[51] Int. Cl.[3] ..... F04B 43/06

[52] U.S. Cl. ..... 417/393; 91/313; 91/436

[58] Field of Search ..... 417/393, 396, 397, 404, 417/403; 91/313, 329, 436

[56] References Cited

U.S. PATENT DOCUMENTS

| | | | |
|---|---|---|---|
| 2,239,727 | 4/1941 | Mayer | 417/393 |
| 3,064,582 | 11/1962 | Knights | 417/393 X |
| 3,791,768 | 2/1974 | Wanner | 417/393 |
| 3,811,795 | 5/1974 | Olsen | 91/313 X |
| 4,019,838 | 4/1977 | Fluck | 417/393 |

FOREIGN PATENT DOCUMENTS

| | | | |
|---|---|---|---|
| 631112 | 10/1949 | United Kingdom | 91/436 |

*Primary Examiner*—Leonard E. Smith

*Attorney, Agent, or Firm*—Sprung, Horn, Kramer & Woods

[57] ABSTRACT

A double diaphragm pump with a novel compressed air control means is described, in which, in addition to a main control valve piston for the control of the compressed air fed to the two air chambers of the diaphragm pump, a pilot control valve means is provided, which drives the main control valve piston pneumatically such that the main valve is retarded at approximately half of the length of its stroke, at which point the main control valve piston separates the two air chambers both from the compressed air inlet and from the exhaust air outlet, and instead connects them together for the purpose of pressure equalization. By this measure in conjunction with novel sealing means for the moving parts, the pressure losses are reduced and thus the efficiency of the pump is increased, the danger of icing up the air exhaust is reduced, and separate provisions for lubrication, such as oil mist lubrication, are dispensed with.

6 Claims, 18 Drawing Figures

COMPRESSED AIR DRIVEN DOUBLE DIAPHRAGM PUMP

BACKGROUND

The invention relates to a compressed-air-driven double diaphragm pump consisting of a pump housing having two housing chambers disposed side-by-side in a spaced-apart relationship, having each a diaphragm assembly and being divided by the latter into a pumping chamber and an air chamber, the air chambers of the two housing chambers being aligned with one another and having between them a compressed air control means which feeds compressed air to the two air chambers and alternatively vents the air chambers, the pump chambers being communicated by valve means with a suction connection and a discharge connection through which the material to be pumped is aspirated into the pump chamber on the basis of the diaphragm movement produced by the compressed air or is forced out of the pump chamber, the compressed air control means having a main valve control piston for the reversal of the air chamber connection paths.

Such compressed-air-driven double diaphragm pumps are already known in a variety of forms.

Figure 1:
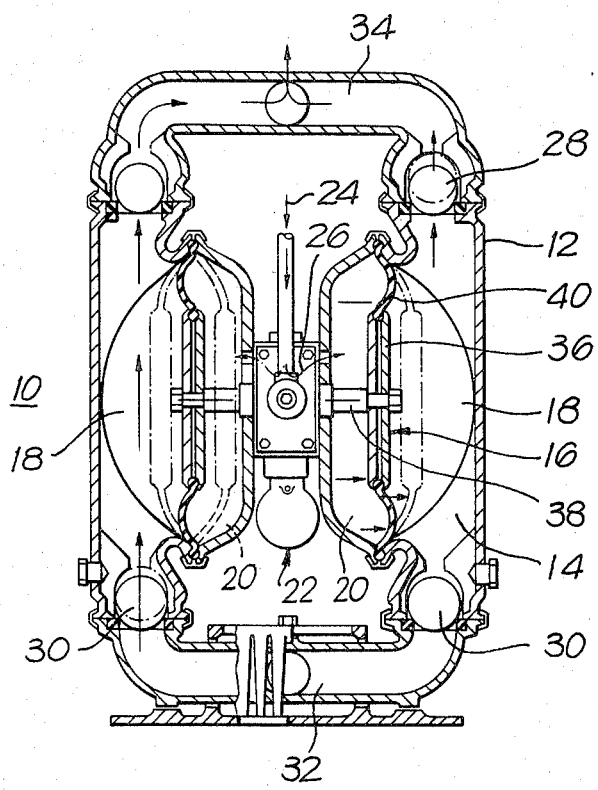

For example, the applicant's Letter of Information LP 004 shows a diaphragm pump of the kind represented in FIG. 1. Such compressed air diaphragm pumps are especially suitable for severe pumping duty, such as for example the pumping of sludges, pulps, dusts and the like. The advantage of such diaphragm pumps lies in the fact that they require no rotating parts and no shaft seals, and they can be run dry without damage. Diaphragm pumps of this kind are non-priming and can be used for either surface or underwater operation. In particular, however, they can also be operated against closed discharge lines without an additional overflow valve.

On account of the compressed-air drive, separate driving means with their required base plates and couplings are unnecessary. Diaphragm pumps of the kind described above are especially compact and easy to transport, and can be used independently of other power sources, such as especially electrical power.

Since no sliding or rotating parts operating in close tolerances are necessary and the velocities of movement are low, abrasive, viscous and shear-sensitive media can be pumped without difficulty.

By changing the rate of delivery of the compressed air the pump also can be regulated very simply, without the need for expensive and complex regulating means.

Figure 2:
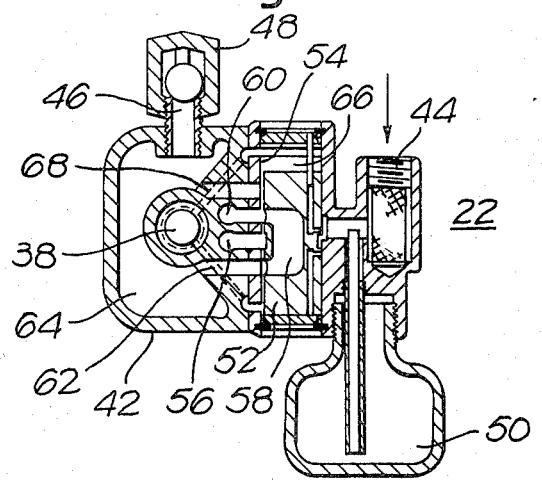

However, the compressed air control means, which is represented in FIG. 2, has still been offering problems. The control valve piston used in the known apparatus as shown in the drawing operates as a two-position valve, which alternately communicates the air chamber represented on the left in FIG. 1 through the outlet with the free atmosphere, and, when reversed, it vents the right air chamber.

The always abrupt venting results in loud air noises and therefore in very noisy operation of the pump. Another environmentally undesirable circumstance is the fact that the oil mist drawn into the drive air from the oil tank to lubricate the piston is undesirably mixed with the exhaust air and can contaminate the surroundings of the diaphragm pump adjacent the exhaust, unless expensive traps and filters are provided. Lastly, at certain positions of the control valve piston a direct path is created between air in areas under the operating pressure and those areas of the pressure control system that are under atmospheric pressure, so that in these valve positions an undesirable loss of compressed air takes place.

Compressed air losses furthermore occur due to the clearances between piston and casing, which cannot be greatly reduced, and which despite the oil lubrication cannot entirely prevent the passage of compressed air.

To sum up, it can be said that the known compressed-air driven double diaphragm pump represented in FIGS. 1 and 2 is of extraordinary simple construction and very rugged, but it does have a very low efficiency and has an adverse effect on the environment due to noise and oil mist.

THE INVENTION

The object of the invention is the creation of a double diaphragm pump of the kind described above, in which the compressed air control system is so designed that the above-described disadvantages are avoided.

This object is achieved by the fact that the main control valve piston is driven by a pneumatically operating pilot control means having a pilot control valve piston, wherein the pilot control valve piston is in turn operated by the movement of the diaphragm assembly.

This arrangement also results in a desirable air lock action preventing direct connection between the operating air and the outside air, on the one hand, and on the other hand the reversal of the main control valve piston can be delayed such that, by appropriate additional measures, which are taught in the subordinate claims, an equalization of pressure is brought about between the two air chambers. By this pressure equalization, which in the state of the art could not be achieved, an improvement of the efficiency is obtained, on the one hand, due to the fact that the unavoidable dead space in the air chambers is filled not by the operating air itself, but by the air vented from the other chamber, before the air chamber is connected to the operating air by the main control valve piston. Furthermore, the pressure equalization considerably reduces the noise that is produced especially in the exhaust.

By the design in accordance with the invention, it becomes possible to use plastic-to-metal sealing surfaces instead of metal-to-metal sealing surfaces, so that oil mist lubrication can be dispensed with.

This not only prevents contamination of the environment with oil mist, but also the air losses due to clearances between the valve piston and valve housing can be largely eliminated, since the metal-to-plastic seals are much tighter than metal-to-metal sealing surfaces.

In this manner, the efficiency can therefore be improved in accordance with the invention.

Since the pressure blow-off that occurs in the exhaust is reduced by the pressure equalization, the danger of icing at the air exhaust is also reduced, so that the pump of the invention can be operated with a higher output than pumps of the state of the art, without greater danger of icing up.

Figure 3:
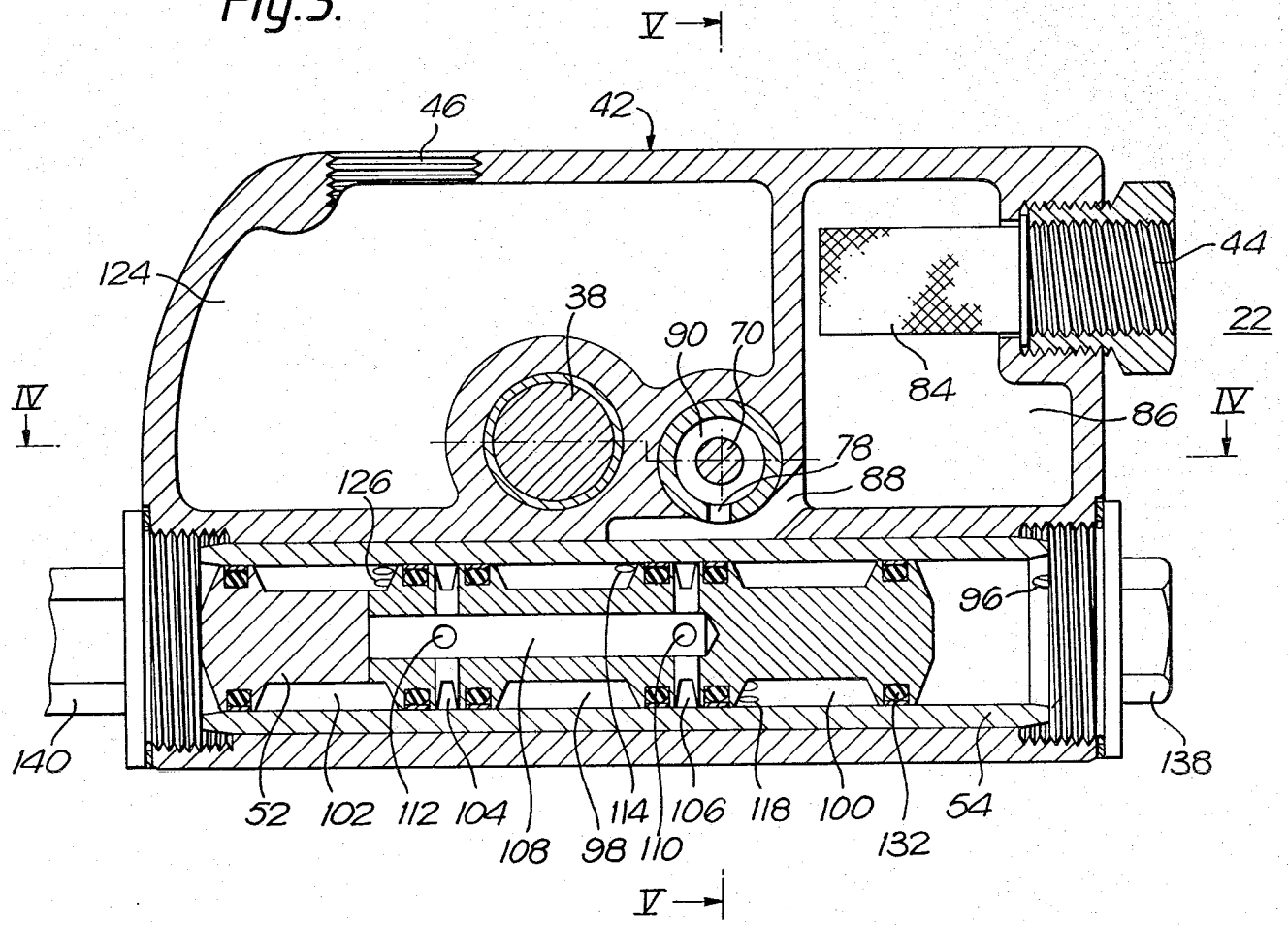
Figure 4:
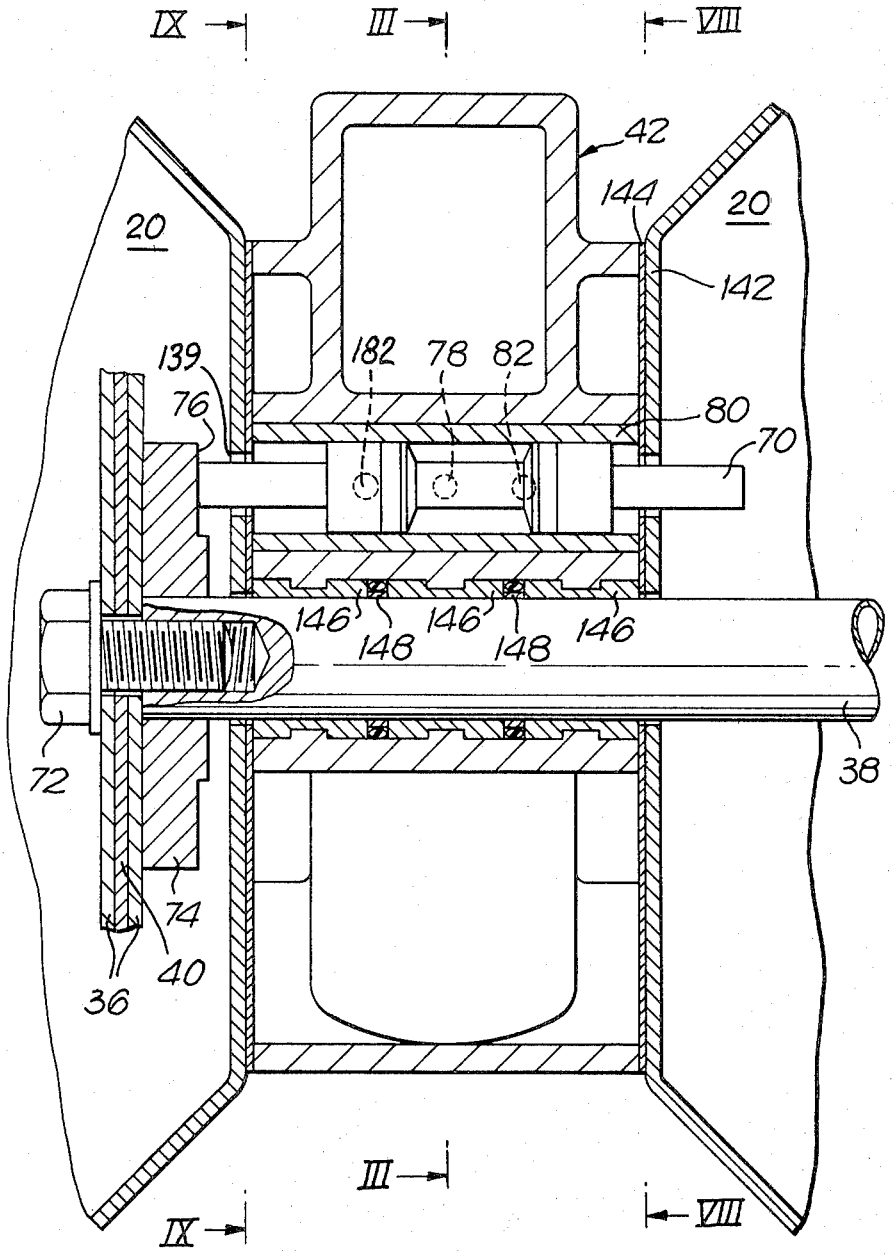
Figure 5:
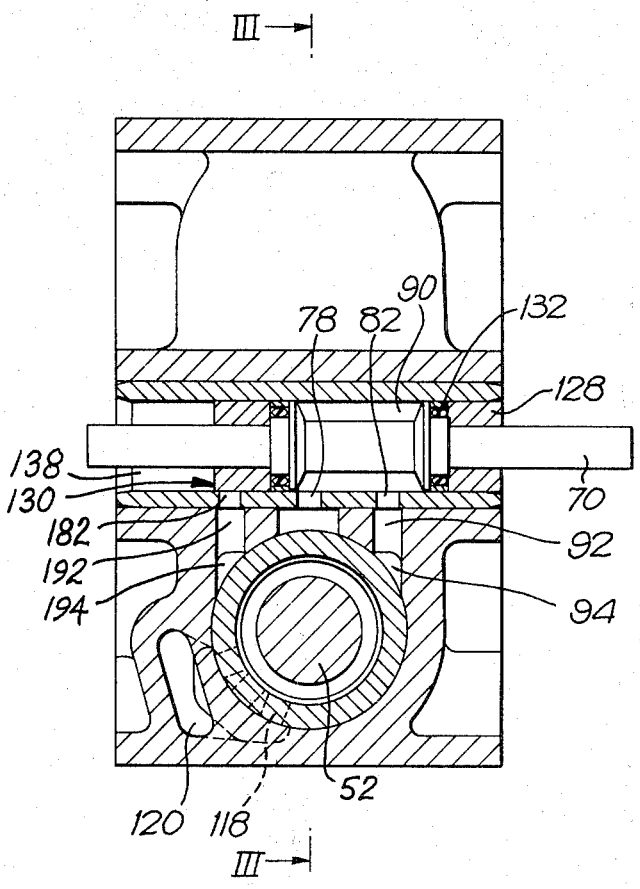
Figure 3A:
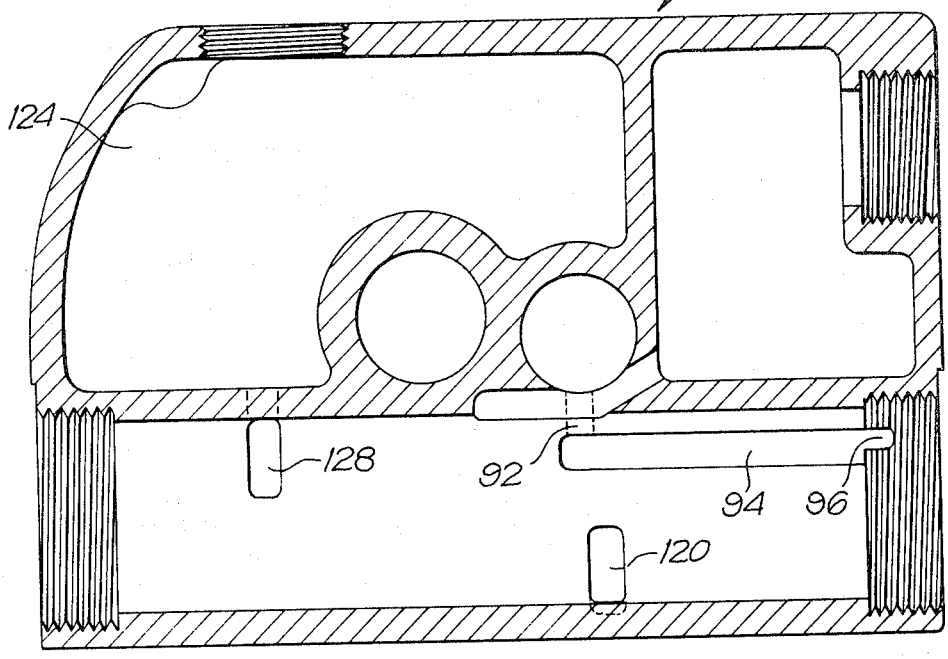
Figure 5C:
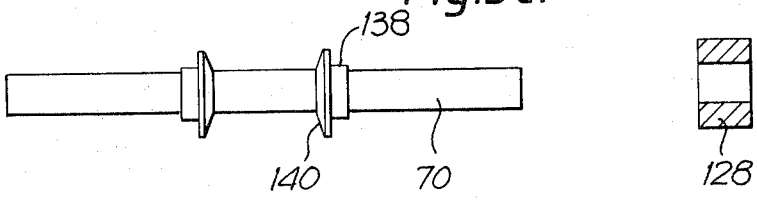
Figure 5B:
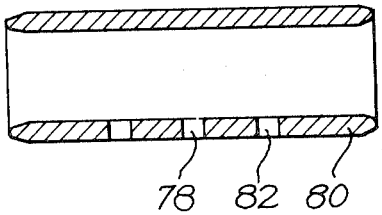
Figure 3B:
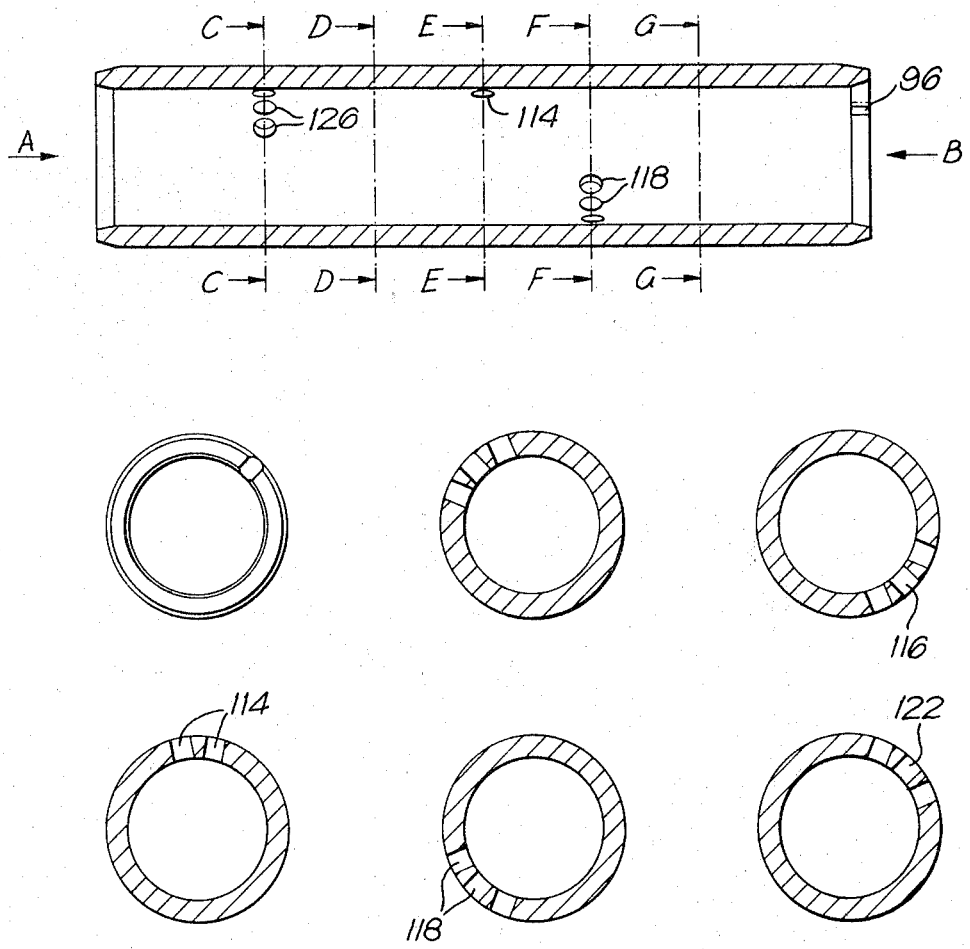
Figure 3C:
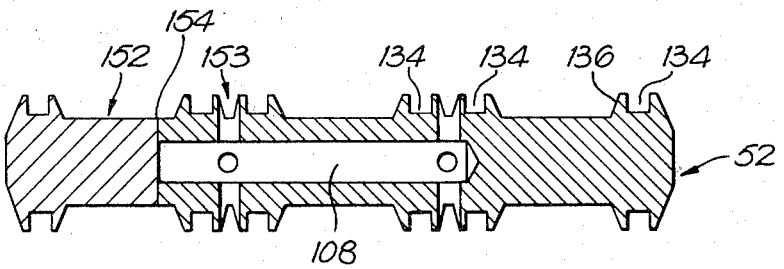
Figure 5A:
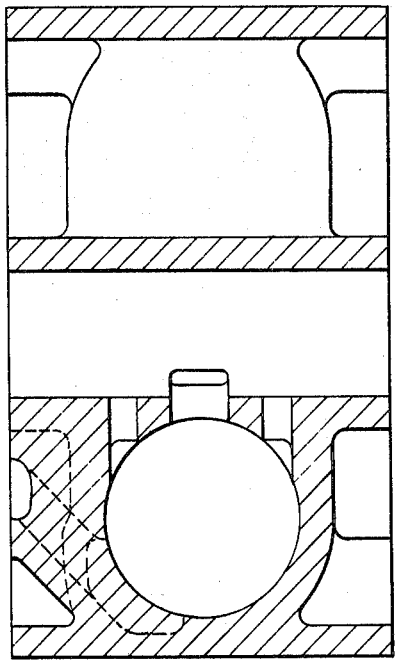
Figure 6:
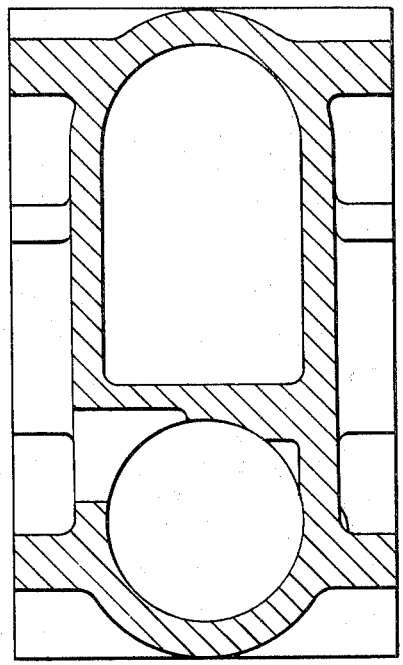
Figure 7:
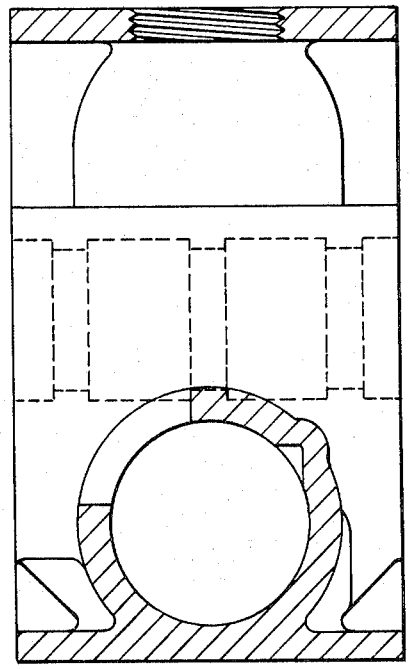
Figure 8:
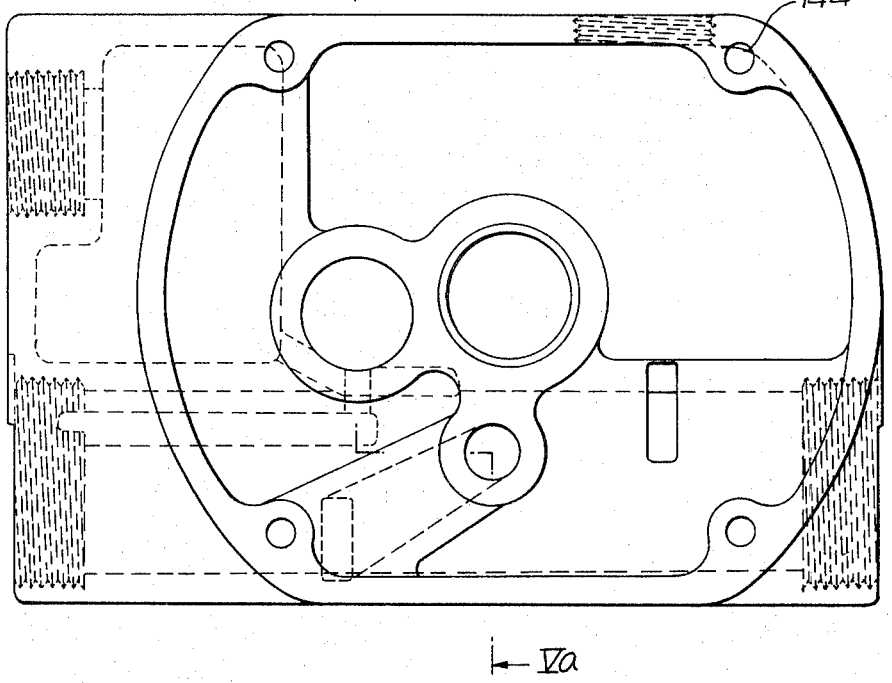
Figure 9:
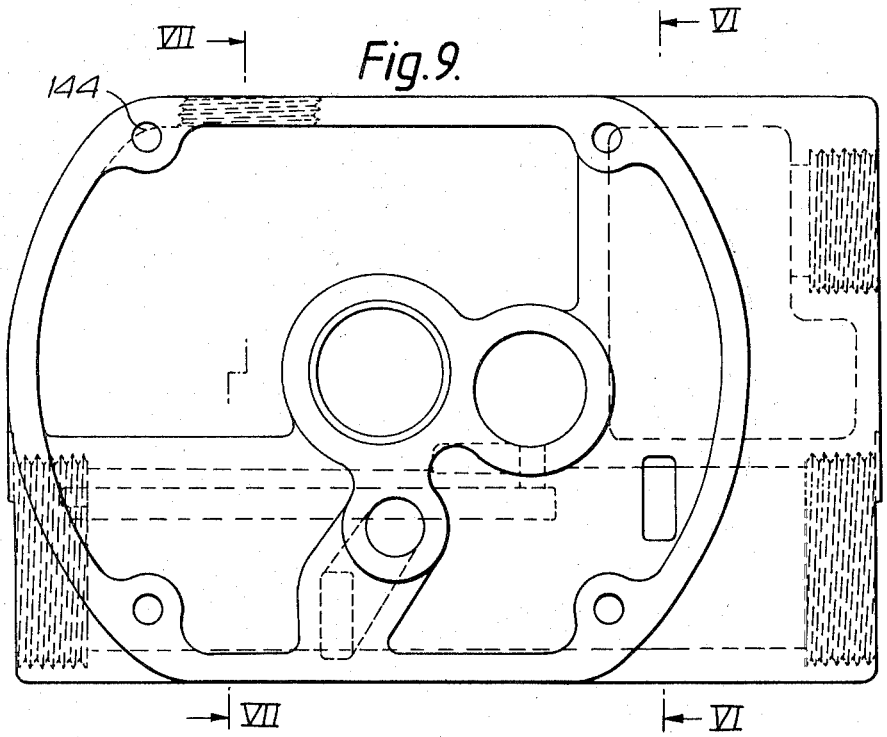
Figure 10:
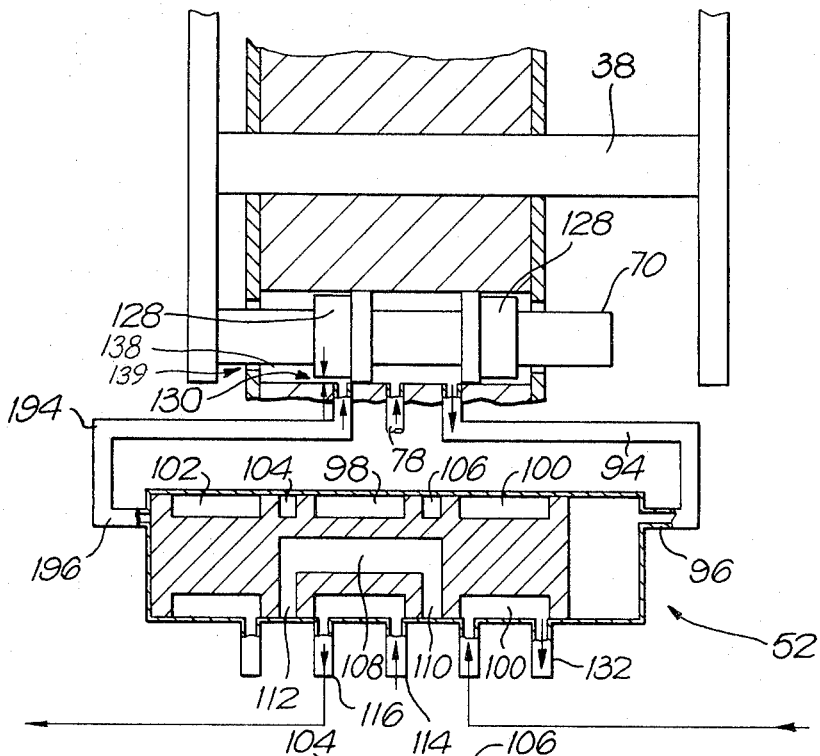
Figure 10A:
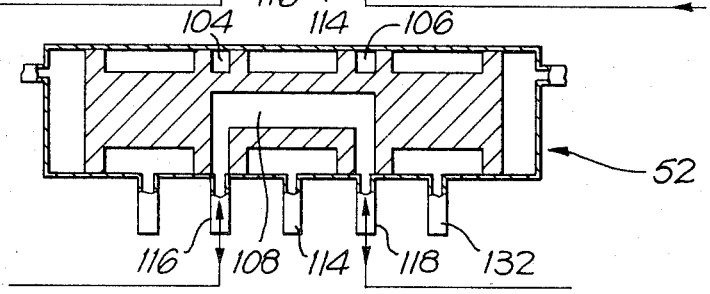
Figure 10B:
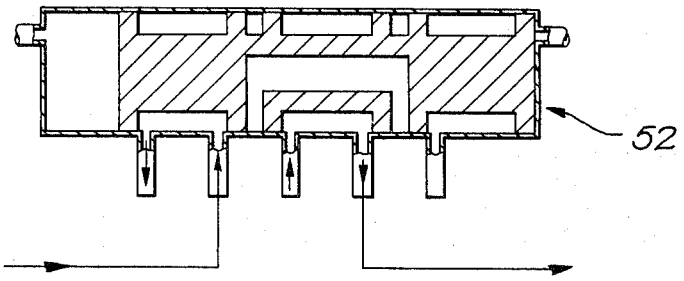

The invention will be further explained hereinafter in conjunction with an embodiment which is represented in the drawings, wherein:

FIG. 1 is a cross-sectional view of a known double diaphragm pump,

FIG. 2 shows a compressed air control means of the prior art, of the kind which can be used in a double diaphragm pump in accordance with FIG. 1, FIG. 3 shows a compressed air control means improved in accordance with the invention, which can be used with the double diaphragm pump of FIG. 1, in a longitudinal cross section taken through the main control valve piston, FIGS. 3*a* to 3*c* show the most important parts of the control means represented in FIG. 3, as individual parts, FIG. 3*b* also showing different radial sections of the part represented in FIG. 3*b*, in addition to an axial cross section, FIG. 4 shows a cross section of the novel control means through the pilot valve axis, the section being taken along line IV—IV of FIG. 3, FIG. 5 is a cross section also taken through the pilot valve axis, but perpendicular to the section of FIG. 4, this section running along the line V—V of FIG. 3, FIGS. 5*a* to 5*c* show individual parts of the assembly represented in FIG. 5, the sectional view of FIG. 5*a* corresponding also to the line Va—Va of FIG. 8, FIG. 6 is a cross-sectional view parallel to the cross section in FIG. 5*a*, taken along the line VI—VI of FIG. 9, FIG. 7 is a cross-sectional view taken along line VII—VII of FIG. 9, parallel to the cross section in FIG. 6, FIG. 8 is a side elevational view of the compressed air control apparatus of the invention as seen from the right in accordance with FIG. 4 in the direction of the arrows VIII—VIII, FIG. 9 is a side view from the left in FIG. 4, in the direction of the arrows IX—IX, and FIGS. 10, 10*a* and 10*b* are diagrammatic representations of three different working positions of the main valve to explain the operation of the compressed air control apparatus of the invention.

FIG. 1 presents a partially diagrammatic cross sectional view of a conventional compressed air-driven double diaphragm pump 10 consisting of a pump housing 12 having two housing chambers 14 disposed side-by-side in a spaced-apart relationship, each having a diaphragm assembly 16 and being divided thereby into a pump chamber 18 and an air chamber 20, the two air chambers 20 being aligned with one another, as is readily apparent, and having between them a compressed air control system 22 which feeds working air entering under pressure from above (see arrow 24) to the two air chambers (arrow 26).

The pumping chambers are in communication through ball valve means 30 having a common suction line 32, which in turn is connected to a reservoir supplying the medium that is to be pumped, and by an additional valve 28 to an again common discharge line 34 communicating with the apparatus to which the material is to be pumped.

The diaphragm assemblies 16 each comprise diaphragm plates 36 each bolted to the end of a diaphragm plunger 38, holding hermetically between them, by its inner margin, an annular diaphragm 40 consisting of a pliable material, while the outer margin of the annular diaphragm 40 is held hermetically between the margins of correspondingly shaped parts of the pump housing 12.

FIG. 2 represents in greater detail the compressed air control system 22 used in the double membrane pump of FIG. 1. This system consists of an air control valve housing 42 which can be bolted to the pump housing, and which has an inlet 44 for working air and an outlet 46 for exhaust air. The outlet 46 leads into a muffler 48 which is to damp at least part of the noise of the exhausted compressed air.

The known air control valve housing of FIG. 2 has an oil reservoir 50, and the working air flowing past the upper end of a tube reaching into this oil reservoir aspirates oil from the oil reservoir 50 and atomizes it, so that the working air then entering the control system entrains fine oil droplets which serve for the lubrication of the moving parts of the air control valve housing. These movable parts include a metal piston 52 which can be moved back and forth between two end positions in a corresponding cylinder 54 consisting of metal and formed by the housing 42.

In the position represented in FIG. 2, working air passes in the direction indicated by arrow 26 of FIG. 1 into the right-hand air chamber 20 on the rear side of the membrane assembly 16, whereupon the air forces the diaphragm outwardly to the position represented in broken lines, thereby pumping the material out of the pump chamber 18 through the upper ball valve 28 into the discharge line 34.

At the same time the other diaphragm on the left side is drawn inwardly and thus aspirates fresh product from the suction line 32 through the lower ball valve 30, represented in the left, into the left-hand pump chamber 18. During this period, the left air chamber is connected by a passage to the exhaust chamber 64, this passage being formed by corresponding ports in the air control valve housing 42, identified by the reference numbers 60 and 62, each to a corresponding passage 58 within the piston 52. At the same time the air chamber 66 above the piston 52 is vented, so that, in spite of the fact that compressed working air is being fed to this chamber through narrow nozzles, the upper air chamber is nevertheless vented. The lower air chamber corresponding to piston 52, however, is not vented, so that there the working air leads to a pressure build-up finally moving the piston 52 upwardly and away from the position represented in FIG. 2, so that now the passage 58 present in the piston 52 interconnects the ports 68 and 56 thus connecting the correct air chamber to the air exhaust chamber 64. At the same time the corresponding connection between the left air chamber and the exhaust chamber 64 is broken, so that pressure can then be built up by the working air in the left air chamber, so that the operating cycle is repeated inversely.

The known air control valve thus supplies both air chambers with working air under all conditions, no matter what the position of the diaphragms. The diaphragm movement is performed in each case by the venting of the air chambers.

This construction of the air control valve requires only one movable piston, which is provided in FIG. 2 with the reference number 52. The fact that the consumption of compressed air is very high, as stated in the beginning, is considered a disadvantage of this simple construction. Furthermore, the piston 52 has to be lubricated by oil mist, which the entering working air draws from the oil reservoir 50.

In FIG. 3 an improved compressed air control means is shown in a longitudinal cross section which is essentially the same as the cross-sectional view in FIG. 2, that is, it is taken through the axis of the main valve control piston 52, and simultaneously intersects perpendicular the diaphragm plunger 38 joining the two diaphragm assemblies 16 rigidly together.

Also, the novel compressed air control system 22 comprises an air control valve housing 42 having an inlet 44 for incoming air and an outlet 46 for exhaust air. A muffler can be provided here, too, but on account of the substantially lower compressed air noise, in accordance with the invention, it is not essential. There is no oil reservoir here, either, since the piston 52 is mounted in its cylinder such that no metal-to-metal friction takes place, as will be explained further on.

The compressed air control system 22 represented in FIG. 3 has, in addition to the main control valve piston, which is driven by compressed air as in the state of the art, a pneumatically operating pilot control system serving for the control of this compressed air, consisting of a pilot control valve piston 70, which as seen in FIG. 3 is disposed at right angles to the main valve 52, so that it is parallel to the diaphragm plunger 38 and thus can be operated mechanically, in a very simple manner, by the movement, for example, of the diaphragm plates 36.

This can be seen more clearly in FIG. 4, which represents a cross section through the diaphragm plunger 38 and the pilot valve piston 70 along line IV—IV of FIG. 3. The view represented in FIG. 4 therefore is substantially the same as that of FIG. 1, so that here, again, the diaphragm 40 is visible, being fastened by diaphragm plates 36 to the end of the diaphragm plunger 38 by means of a bolt 72. The end of the diaphragm plunger 38 furthermore bears a strike plate 74 whose inner annular surface 76 abuts against the end of the pilot valve piston 70 and moves it in an opposite direction as the diaphragm plunger 38 reaches its end position. As seen in FIG. 4, this is the position farthest to the right, in which the pilot valve 70 is shifted to the right, as represented. The pilot valve piston 70 is shaped such that, in this position it connects a central port 78 in the pilot valve cylinder 80 with a port 82 on its right as seen in FIG. 4, which can also be seen in FIG. 5, the latter figure being a section taken through the pilot valve axis perpendicular to the cross-sectional view of FIG. 4; see also arrows 5—5 of FIG. 3. The port 78 can also be seen in FIG. 3 representing a longitudinal section through the main valve 52 and therefore a cross section along the line III—III of FIG. 5. As it can be seen, the working air fed to the inlet 44 flows through a dust filter 84, for example, into the air inlet chamber 86 and from there to the passage 88, from which the air passes through the port 78 into the annular chamber 90 formed by the pilot valve 70. From there the air then passes, with the pilot valve 70 in the position shown in FIG. 5, through the port 82 into a passage 92 leading to a passage 94 which can be seen in FIG. 3*a* (showing only the air control valve housing 42 in a cross-sectional view similar to FIG. 3) and which terminates at the right end of the cylinder 54 in an opening 96. The right end of the main valve 52 represented in FIG. 3 is therefore under the pressure of the working air and the main valve therefore assumes the leftward position shown in FIG. 3. This position is represented diagrammatically also at the top of FIG. 10, this diagrammatic representation simultaneously showing a longitudinal view of the two valves 52 and 70 situated at right angles to one another.

Like the pilot valve, the main valve 52 together with its cylinder 54 forms annular chambers 98, 100 and 102 which serve for the interconnection of various passages which in turn terminate in ports which are visible partially in FIG. 3, but which can all be perceived in the various radial cross sections shown in FIG. 3*b*.

In addition to these three rather broad annular chambers 98, 100 and 102, the main valve 52 also forms two narrow annular chambers 104 and 106, which communicate with one another through a bore 108 in the valve piston 52 and through a radial bore 110 and 112 each extending from this axial bore 108.

As it can be seen from FIG. 3, the passage 88 and hence the air coming in under pressure communicates through port 114 with the annular chamber 98, which in turn communicates with the left air chamber in FIG. 4 via an opening in cylinder 54 which is above the plane of the drawing and therefore not visible (can be seen in cross section D of FIG. 3*b*, marked with the reference number 116) and via an additional passage running from this opening. The ports in cylinder 54 which are associated with the connection to the right air chamber, however, are to be seen in FIG. 3, at reference number 118. These ports 118 open (see FIG. 3*a*) into passage 120, which can also be seen in FIG. 5, and which communicates with the right-hand air chamber. Since otherwise the annular chamber 100 communicates through openings 122 located above the plane of the drawing in FIG. 3 (see section G of FIG. 3*b*), and through a passage to the exhaust air chamber 124, a desired venting of the right-hand air chamber results. The corresponding ports 126 for the other air chamber can again be seen in FIG. 3, as well as the corresponding passage 128 leading to the exhaust air chamber 124 (see FIG. 3*a*).

The condition described above will not continue for long. Due to the incoming air flowing through the central passage 108 of the main valve 52 and entering into the lefthand air chamber, the pressure in the left air chamber will increase, and when it reaches the pressure prevailing in the corresponding pump chamber, the left diaphragm, and with it the corresponding diaphragm plate and the piston rod 38, will be shifted leftward. This causes the diaphragm plate to move away from the end of the pilot valve piston 70. The pilot valve, however, will remain in its place, since the right-hand membrane with its corresponding diaphragm plate will not reach the right end of the pilot valve piston 70 and push it to the left until the end of the pumping stroke. As it can be seen in FIG. 10, this causes a changeover such that now the incoming air entering through the passage 78 no longer passes into the right-hand passage 94 to reach the right end of the main valve 52, but passes instead through the left-hand passage provided with the reference number 194 to the port 196 and hence to the left end of the main valve 52. Thus the main valve 52 begins to shift to the right, but only slowly, since the air on the right side of the main valve piston 52 has to flow through the port 96 and the passage 94 past a constriction into the right air chamber which at this time is vented, the construction being formed by a ring 128 which is borne by the pilot control valve piston and has an only slightly smaller diameter than the inside diameter of the pilot valve cylinder 80. The annular gap 130 thus resulting between the cylinder wall and the outer circumference of the nozzle ring is so dimensioned that under the working conditions the main valve is moved in the opposite direction at a predetermined reduced velocity. There is a special reason for this.

As can be seen in FIG. 5, annular space 138 and constriction 130 which comprise the left pilot passage lead into the main control passage composed of port 182, passage 192 and passage 194. As can be seen in FIG. 4, air from air chamber 20 flows through passage 139. By reference to FIG. 10, it is seen that passage 139 leads into annular space 138 which in turn leads into constriction 130. Air chambers 20 and thus connected to main valve 52 (See FIG. 5).

It has already been stated that it is desirable to bring about a pressure equalization between the two air chambers prior to the stroke reversal of the diaphragm pump, because thus, on the one hand, pressure energy is better utilized and thus efficiency is improved, and on the other hand, the exhaust air released to the free atmosphere has a lower pressure than the working air, so that the exhaust noise is reduced and the danger of icing up is reduced.

This pressure equalization is achieved through an intermediate position, represented at 2 in FIG. 10, which persists for a sufficient amount of time on account of the slow reversal of the main valve 52. In this intermediate position the central bore 108 with its annular chambers 104 and 106 connects the ports 116 and 118 to one another, while the ports 132 communicating with the exhaust air chamber, and also the ports 114 in annular chambers 100, 102 and 98 communicating with the incoming air chamber, terminate blind and thus are closed, as is indicated by the crosses. Thus only one connection remains between the left air chamber and the right air chamber, so that the desired pressure equalization between the two air chambers is accomplished through ports 116 and 118 plus corresponding connecting passages as well as the axial bore 108 in the main valve 52. Since no constrictions are provided in this path of communication, a sufficiently rapid pressure equalization results, so that the main valve does not have to be shifted extremely slowly, and all that is necessary is to prevent the abrupt overshooting movement which would occur without the constriction 130 described in conjunction with the pilot valve 70.

The energy won by the pressure equalization depends on the size of the dead volume of the air chamber when the diaphragm pump is in the end position. By means of the pressure equalization, this dead space, which at first is at atmospheric pressure, is elevated by the right air chamber, which is under working pressure, to a pressure which, depending on the volumetric ratio between the dead space and the other maximum-size air chamber, is either just slightly less than the working pressure (in the case of a very small dead space), or else it is a little less than that, if the dead space assumes a larger portion of the available space. In both cases one saves, by the pressure equalization, the filling of the dead space with expensive pressurized working air, and working air therefore is needed only for the purpose of performing the actual working stroke. Depending on the size of the dead space, efficiency improvements between 10 and 30% can be achieved in conventional double-diaphragm pumps.

Another advantages is to be seen in the fact that, in no position of the diaphragm plunger is there a direct connection between the working air and the exhaust, as in the state of the art, so that, if the diaphragm plunger should stop at any point, on account of a clogged discharge of the material being pumped, no working air will be consumed. In the state of the art it could happen that, at certain positions of the diaphragm plunger, this direct connection would exist, resulting in a constant blow-off of working air, with correspondingly high operating costs.

Finally, when as shown in FIG. 10*b* the main valve piston has reached the right-hand position as shown, conditions are just the reverse of FIG. 1, so that now the left-hand air chamber communicates with the exhaust air chamber and hence with the atmosphere, so that now the only remaining pressure, greatly reduced by the pressure equalization, is released to the free atmosphere, while the right air chamber is charged with incoming compressed air until the pressure in the right air chamber has again reached the pressure of the medium being pumped, whereupon the pump performs its next stroke.

The bores in cylinder 54 for the main control piston, as well as the annular chambers of the main control piston, are so aligned with one another that, when the pilot valve shifts and hence the air for driving the main control piston is reversed, the main control piston first advances rapidly on the first half of its stroke and reaches the position represented in FIG. 10*a*. In the meantime, however, due to the throttling in the pilot valve (annular gap 130) a cushion of air has built up on the exhaust side of the main control piston, so that rather precisely in this central position in the main valve piston 52 is greatly retarded and thus remains for a sufficiently long time in the position wherein the pressure compensation can take place due to the overflowing of air from the one air chamber to the other. At the same time, the incoming air and exhaust are cut off and only the two air chambers are connected to one another. In the other position last reached, the filling of the previously vented air chamber begins, as well as the venting of the previously filled other air chamber which has been partially vented by pressure equalization.

The savings in compressed air consumption due to the above-described pressure equalization become greater if the diaphragm pump is operated, for various reasons, with a reduced length of stroke. This is because the dead spaces increase if the stroke length is reduced.

An additional advantage is to be seen in the fact that the air chambers are no longer abruptly emptied of their full working pressure upon the reversal, but only of the reduced pressure achieved by the pressure equalization, thereby avoiding severe pressure peaks, which not only produce excessive noise but also strain the individual parts of the pump.

It has already been stated that the novel design operates without oil mist. This can be brought about by making the main valve and pilot valve to consist of cylinder sleeves 54 and 80, respectively, and valve pistons 52 and 70 slidingly contained therein, these pistons having annular grooves (e.g., the wide circumferential grooves 98, 100 and 102 on piston 52, as well as the narrow circumferential grooves 104 and 106 and also the circumferential groove of the pilot piston 70, which is provided with the reference number 90), which are sealed off by piston rings of resilient material. These piston rings, which are marked 132 in FIG. 3, are laid in corresponding grooves 134 in annular piston flanges 136, see FIG. 3*c*. In the case of the pilot valve piston, a corresponding piston ring 132 is pushed onto an annular surface 138 (see FIG. 5*c*) against a flange 140, and then held in place by the constriction ring 128 which is installed afterward; see also FIG. 5.

These piston rings 132 can, of course, be of a conventional type; for example they can be regular commercial jacketed rings consisting of an inner O-ring of rubber material and an outer friction ring of PTFE (Teflon). Jacketed rings have a lower friction than plain rubber-elastic sealing rings, and they break loose more easily after long shutdowns, and they also have a high wear resistance even when run completely dry. PTFE is ordinarily filled with powdered bronze, so that good dry running systems can be achieved in comparison to the metal parts of valve systems, which are also made of bronze alloys, for example.

The ring 128 serving as a constricting means can also be made of PTFE and, for example, can form between its outer circumference and the inner surface of the piston cylinder 80, a gap of about 0.2 mm, which usually suffices to achieve the desired air throttling action and therefore the delay of the main valve.

The piston rings which have been described make it possible to prevent any air losses between the piston and the piston cylinders, even though no oil lubrication is provided.

The use of cylinder insert sleeves which are inserted into a housing 42 makes it possible to manufacture the casing 42 of pressure-cast metal and the result is a very simple and cost-saving manufacturing process involving no expensive metal machining.

The ports in the valve cylinder sleeves 54 and 80 (in FIG. 3*b*, for example, 114, 118, 126) could also be in the form of elongated holes disposed circumferentially, but it is easier to make a series of successively disposed round holes which also provide better support for the sealing rings as they pass over these ports.

To manufacture the main piston 52 in accordance with FIG. 3*c*, especially its axial bore 108, the component is either first made of two parts 152 and 153, see FIG. 3*c*, or an integral component is cut apart at point 154 and then the axial bore 108 is created, and then the two parts 152 and 153 are joined together, by welding, for example.

After its insertion into the housing, the main valve system, consisting of the cylinder 54 and the piston 52, is locked in place by means of threaded end caps 138 and 140; see FIG. 3.

In the case of the pilot valve, the valve cylinder 80 and the piston 70 are held by the housing wall 142 of the diaphragm pump (see FIG. 4) to which the air control valve housing 42 can be bolted with the interposition of a gasket 144. Corresponding taps are visible in FIGS. 8 and 9 and provided with the reference number 144.

The overall construction of the compressed air control means in accordance with the invention is so designed that it can be used on diaphragm pump units of different sizes. In particular, the control means can be used for any stroke lengths of the diaphragm, because the control is operated only in the last part of any diaphragm stroke, i.e., the operating stroke of the pilot valve is independent of the working stroke of the diaphragm and especially it is much smaller than the working stroke of the diaphragm. This not only increases the versatility of the control means, but also reduces wear.

With the above-described compressed air control means for a double diaphragm pump, primarily a higher efficiency is thus achieved, since no air losses occur during the pumping stroke and in the control valve operating phases, particularly during the operation of the pump against higher back pressures of the material being pumped (pressures, for example, of several bars), or even when at a standstill under full air pressure with the pump discharge line stopped up (pressure stall). The improved sealing of the valve pistons in their cylinders contributes also to this increase of efficiency on account of the avoidance of losses due to leakage.

As a result of the reduced pressure level of the exhausted air, noise and the danger of icing are reduced. Since lubrication is unnecessary, there is no longer any need for constantly checking an oil reservoir, and contamination of the material being pumped and of the environment of the pump by oil mist is also eliminated.

Due to the special design of the invention, the compressed air control means can be manufactured relatively economically as a mass product, and the component parts, especially the cylinder sleeves of the valves, can easily be replaced, as can the valve pistons and their rings.

Also the diaphragm plunger 38 (see FIG. 4) is mounted in replaceable guide rings of which three are represented in FIG. 4 and provided with the reference number 146. Between each two of these guide rings 146 are likewise replaceable sets of seals 148, which are similar in construction to the seal rings 132, i.e., they are made of a PTFE sealing ring charged with bronze and an O-ring made of synthetic rubber, for example, as the compression ring.

Due to the special design of the invention, the compressed air control means can be manufactured relatively economically as a mass product, and the component parts, especially the cylinder sleeves of the valves, can easily be replaced, as can the valve pistons and their rings.

Also the diaphragm plunger 38 (see FIG. 4) is mounted in replaceable guide rings of which three are represented in FIG. 4 and provided with the reference number 146. Between each two of these guide rings 146 are likewise replaceable sets of seals 148, which are similar in construction to the seal rings 132, i.e., they are made of a PTFE sealing ring charged with bronze and an O-ring made of synthetic rubber, for example, as the compression ring.

I claim:

1. Compressed air driven double diaphragm pump (10) consisting of a pump housing (12) having two housing chambers (14) disposed side by side in a spaced-apart relationship, each having a diaphragm assembly (16) and being divided by the latter into a pumping chamber (18) and an air chamber (20), the air chambers (20) of the two housing chambers (14) being aligned with one another and having between them a compressed air control means (22) which feeds compressed air to the two air chambers (20) and alternately vents the air chambers, the pumping chambers (18) communicating through valve means (28, 30) with a suction (32) and a discharge (34) through wich the material being pumped is aspirated into and forced out of the pumping chamber (18) on the basis of the diaphragm movement produced by the compressed air, the compressed air control means (22) having a main control valve piston (52) for the changing of the air chamber connecting paths, characterized in that the main control valve piston (52) is driven through a pneumatically operating pilot control system having a pilot control valve piston (70), the pilot control valve piston (70) being operated in turn by the movement of the diaphragm means (26), the main control valve piston (52) passing through a center position in which the air chambers (20) are separated from the working air in the one case and the atmospheric air in the other, in the center position of the main control valve piston (52), the two air chambers (20) being connected to one another.

2. In a double diaphragm pump according to claim 1, the improvement which comprises a pilot control system having an outlet passage with a constriction in the outlet passage for the driving air displaced by the main control valve piston, retarding the pneumatic operation of the main control valve piston.

3. In a double diaphragm pump according to claims 1 or 2, the improvement which comprises a pilot control system operating pneumatically on reaching the end positions of the diaphragm assemblies.

4. In a double diaphragm pump according to claim 1, 3, or 2, the improvement which comprises cylinder sleeves being inserted into a die-cast housing and slidingly receiving the valve pistons to form main valve and pilot valve.

5. In a double diaphragm pump according to claim 4, the improvement which comprises valve pistons having annular grooves which are closed off by sealing rings of yielding material.

6. In a double diaphragm pump according to claim 2, the improvement which comprises a constriction being formed by the wall of the pilot piston cylinder and a ring pushed onto the pilot control valve piston.

* * * * *

UNITED STATES PATENT AND TRADEMARK OFFICE

CERTIFICATE OF CORRECTION

PATENT NO. : 4,406,596

DATED : September 27, 1983

INVENTOR(S) : Dirk Budde

It is certified that error appears in the above-identified patent and that said Letters Patent is hereby corrected as shown below:

| | |
|---|---|
| First Page | Insert --Foreign Priority Data 3/28/81 Germany 31 12 434-- |
| Col. 6, line 54 | Delete "construction" and insert --constriction-- |
| Col. 7, line 55 | Delete "advantages" and insert --advantage-- |
| Col 10, line 48 | Delete "wich" and insert --which-- |

Signed and Sealed this

*Eighteenth* Day of *September 1984*

[SEAL]

*Attest:*

GERALD J. MOSSINGHOFF

*Attesting Officer*

*Commissioner of Patents and Trademarks*